United States Patent [19]

Wille

[11] Patent Number: 4,811,310

[45] Date of Patent: Mar. 7, 1989

[54] TRANSDUCER MOUNTER

[76] Inventor: Mark E. Wille, 133 Saeger Ave., Oconomowoc, Wis. 53066

[21] Appl. No.: 48,660

[22] Filed: May 12, 1987

[51] Int. Cl.[4] ..... H04R 15/00

[52] U.S. Cl. ..... 367/173; 367/191; 248/286; 248/291

[58] Field of Search ..... 181/108, 109, 110, 139, 181/140, 123, 124, 149, 198, 207, 208; 248/205.5, 205.6, 286, 291, 640, 641, 642, 643, 222.4, 223.1, 223.2; 312/7.1, 7.2; 114/322, 343, 197; 367/99, 106, 130, 140, 162, 165, 173, 176, 188, 910

[56] References Cited

U.S. PATENT DOCUMENTS

| | | | |
|---|---|---|---|
| 605,510 | 6/1898 | Patchett | 248/223.1 X |
| 3,242,899 | 3/1966 | Hanson | 248/641 X |
| 3,714,619 | 1/1973 | Morgon et al. | 248/291 X |
| 3,729,162 | 4/1973 | Salvato | 248/291 |
| 3,976,274 | 8/1976 | Langguth | 248/205.6 X |
| 4,534,307 | 8/1985 | Overs | 114/197 X |

*Primary Examiner*—Brian S. Steinberger

*Attorney, Agent, or Firm*—Fuller, Puerner & Hohenfeldt

[57] ABSTRACT

A transducer mounter comprises a portable housing adapted to have a wide variety of transducers fastened thereto. The housing is adjustable and releasably mounted to a boat transom by a suction cup and by an adapter that extends through the boat drain hole. The adapter and suction cup include resepective nuts that releasably hold the housing against the boat transom. Removing the nuts renders the housing and transducer portable as a unit. The present further includes a modified embodiment in which the housing is permanently mounted to the boat, but which, because of the housing design, permits adjustment of the transducer on the housing.

12 Claims, 2 Drawing Sheets

TRANSDUCER MOUNTER

BACKGROUND OF THE INVENTION

1. Field of the Invention.

This invention pertains to marine equipment, and more particularly to apparatus for mounting sonar transducers on a boat.

2. Description of the Prior Art.

Many sportsmen use sonar transducers to determine likely spots for successful fishing. The sonar equipment locates elusive fish and therefore increases the likelihood of catching them.

A recurring problem when using sonar equipment is the placement and retention of the transducer within the boat. In some applications, the transducer is temporarily mounted to a gunwale. That location is undesirable, because the exposed transducer is subject to accidental bumping and damage. It is known to attach transducers directly to the boat transom by means of screws turned into the hull. Such mounting is unacceptable to many boat owners, because the transducer location cannot be adjusted without drilling additional holes into their boats. Moreover, fishermen who rent boats are handicapped by the lack of suitable devices for temporarily mounting their personal transducers to the rental boats.

Thus, a need exists for means to adjustably and temporarily mount sonar transducers to fishing boats.

SUMMARY OF THE INVENTION

In accordance with the present invention, a transducer mounter is provided that permits quick and easy attachment and removal of sonar equipment on a boat without altering the hull. This is accomplished by apparatus that includes a portable housing that is temporarily but securely mounted to the boat transom by using pre-existing boat structural features. In the preferred embodiment, the transducer mounter comprises an elongated 5-sided housing having side walls and a front wall that form a generally U-shaped cross section. One end of the housing front wall defines a relatively large obround hole having the major dimension perpendicular to the longitudinal axis of the housing. The transducer mounter further includes a drain plug adapter in the form a hollow bolt. The drain plug adapter is designed to extend through the boat drain hole, with the boat held bearing against the inside of the boat transom and the threaded shank protruding through the drain hole. The adapter is held in place in the drain hole by a jam nut turned onto the adapter threads and bearing against the outside of the boat. To prevent leakage through the drain hole past the adapter, a seal, such as an O-ring, is interposed between the adapter head and the inside transom surface. The boat drain plug is inserted in the adapter passage, where the plug functions in the normal fashion.

The obround hole of the housing first longitudinal end is passed over the protruding adapter threaded shank. A knob threaded onto the adapter threads secures the housing first end tightly but temporarily against the transom. To protect the boat surface, the housing first end includes a soft bumper that bears against the transom.

The second end of the housing is secured to the boat by means of a suction cup that has a threaded stem. The cup is pressed against the transom such that the stem extends through one of several longitudinal slots formed in the housing front wall. A nut turned onto the stem and bearing against the housing front wall completes the mounting of the transducer mounter to the boat without damage or modification thereto.

The transducer is adjustably fastened to the housing by means of screws passing through the housing slots and secured by nuts. The arrangement of the housing slots permits fastening a wide variety of transducer models and mounting brackets to the transducer mounter of the present invention. The housing slots permit convenient adjustment of the transducer longitudinally along the housing without moving the housing on the boat. At the same time, the housing can be adjusted angularly on the transom by means of the knob and housing obround mounting hole. The attachment of the housing to the boat by means of the drain hole adapter and the suction cup render the housing and transducer readily portable as a unit, thereby permitting easy removal from the boat for safekeeping at the end of the day's fishing.

In some situations, a fisherman may want to permanently mount the transducer mounter to his boat. For that purpose, the housing contains holes for receiving screws that are threaded directly into the boat transom. In that case, the suction cup and drain hole adapter are not used. Adjustment of the transducer on the housing remains possible because of the longitudinal slots.

Other objects and advantages of the invention will become apparent to those skilled in the art upon reading the disclosure.

DETAILED DESCRIPTION OF THE INVENTION

Although the disclosure thereof is detailed and exact to enable those skilled in the art to practice the invention, the physical embodiments herein disclosed merely exemplify the invention which may be embodied in other specific structure. The scope of the invention is defined in the claims appended hereto.

Figure 2:
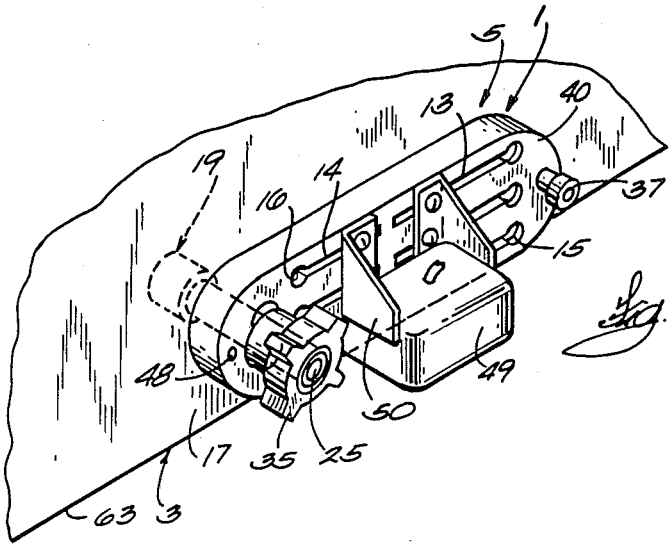
FIG. 2 is a perspective view of the transducer mounter installed on a boat transom.
Figure 1:
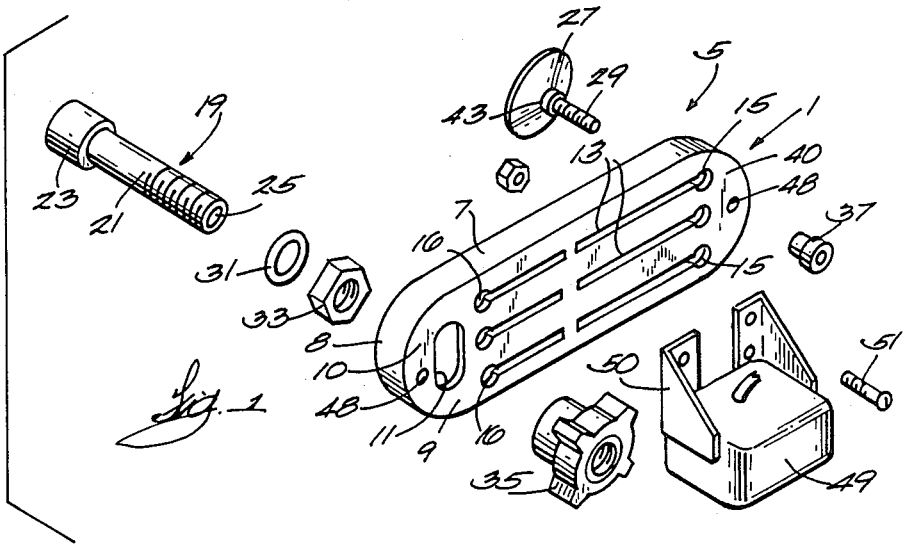
FIG. 1 is an exploded perspective view of the transducer mounter of the present invention.
Figure 3:
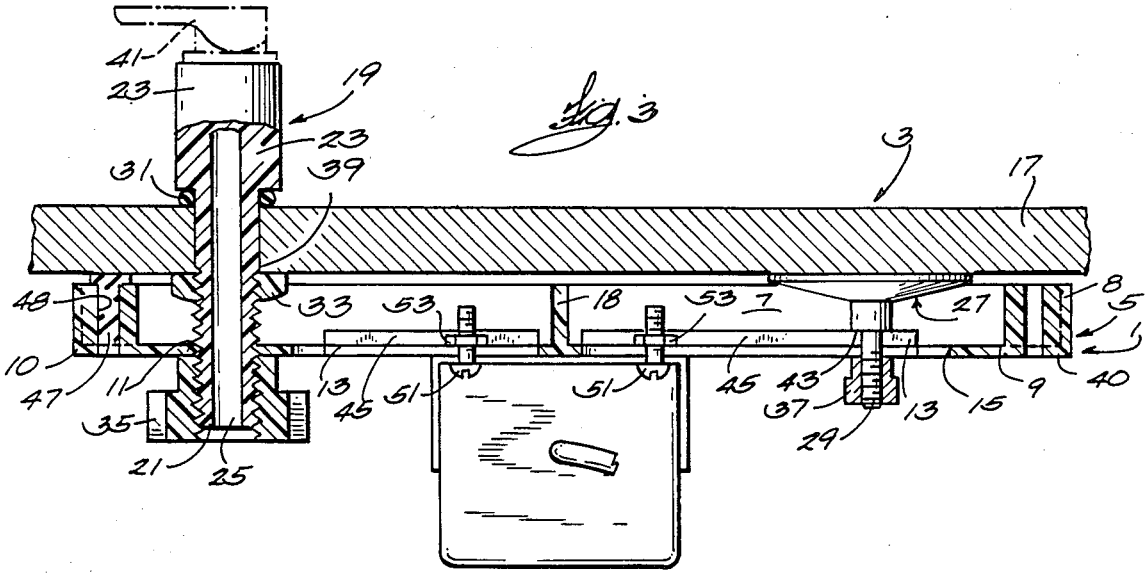
FIG. 3 is a horizontal cross-sectional view of the transducer mounter installed on a boat transom.

Referring to FIGS. 1–3, a transducer mounter 1 is illustrated that includes the present invention. The transducer mounter is particularly useful for fastening sonar equipment to a fishing boat 3, but it will be understood that the invention is not limited to fishing applications.

The transducer mounter 1 comprises a portable housing 5 that has opposed side walls 7 connected by semicircular end walls 8 and a front wall 9. Near the housing first end 10, the front wall 9 defines a large obround hole 11 having a major axis that is transverse to the housing longitudinal axis. The front wall further defines a series of longitudinally extending slots 13 having outer ends that terminate in enlarged holes 15 near the housing second end 40. Similar slots 14 have outer ends that terminate in enlarged holes 16 near the hole 11. A transverse leg 18 (best shown in FIG. 3) connects the side walls 7 and stiffens the front wall between the inner ends of the slots 13 and 14.

The first end 10 of the housing 5 is mounted to the transom 17 of the boat 3 by means of a drain plug adapter 19. As best shown in FIGS. 2 and 3, the drain plug adapter 19 is preferably formed as a hollow bolt having a treaded shank 21, an enlarged head 23, and a passage 25 extending through the shank and head.

Reference numeral 27 indicates a suction cup having an elongated threaded stem 29. The transducer mounter 1 of the present invention further comprises an O-ring 31, jam nut 33, threaded knob 35, and brass nut 37.

Referring especially to FIG. 3, the transducer mounter 1 is securely but temporarily mounted to the boat transom 17 without altering or damaging the boat by making use of the boat drain hole 39. The adapter shank 21 extends through the drain hole 39 with the head 23 on the inside of the boat 3. The jam nut 33 is threaded onto the exposed shank from the outside of the transom. To prevent water from leaking into the boat through the drain hole around the shank, the O-ring 31 is installed on the shank against the head shoulder. To seal the passage 25, the conventional boat drain plug 41 is assembled to the adapter hollow head.

The hole 11 of the transducer mounter housing 5 is positioned on the exposed shank 21 of the adapter 19. The knob 35 is turned onto the shank to thereby secure the housing first end 10 to the boat 3. Preferably one of the housing side walls 7 is flush with the bottom corner 63 of the boat when the knob is tightened.

The second end 40 of the housing 5 is mounted to the boat by means of the suction cup 27 pressed onto the transom 17. The suction cup stem 29 passes through one of the slots 13. The brass nut 37 is turned onto the stem to seat against the housing front wall 9 and hold the housing second end to the boat. Shoulder 43 of the suction cup rests against and straddles a pair of longitudinally extending ribs 45 that lie alongside slots 13 and 14.

To reduce transmission of boat vibrations, especially in aluminum boats, and to protect the boat's surface, the housing 5 does not directly contact the transom 17. Rather, as best shown in FIG. 3, a bumper 47 of rubber or similar soft material is inserted into a hole 48 in the housing first end 10. The bumper 47 therefore acts both as a vibration mount and as a protective pad. Similarly, the suction cup 27 serves the secondary purpose of isolating the housing end 40 from the transom.

To fasten a sonar transducer 49 to the transducer mounter 1 of the present invention, a suitable mounting bracket 50 and conventional screws 51 and nuts 53 are employed, together with lock washers, not shown. The number and location of the slots 13 and 14 enable the housing 5 to accommodate a wide variety of transducers 49 and mounting brackets 50. The nuts 53 straddle the housing ribs 45 alongside the slots. The transducer and mounting bracket may be fastened at any desired location along the slots. The obround hole 11 permits easy angular adjustment of the housing on the boat without having to move the transducer on the housing.

With the drain hole adapter 19 and suction cup 27 installed, the housing 5 and transducer 49 remain readily portable. The housing is easily removed from the boat 3 when desired by unscrewing knob 35 and nut 37 while leaving the adapter and suction cup secured to the boat.

Figure 4:
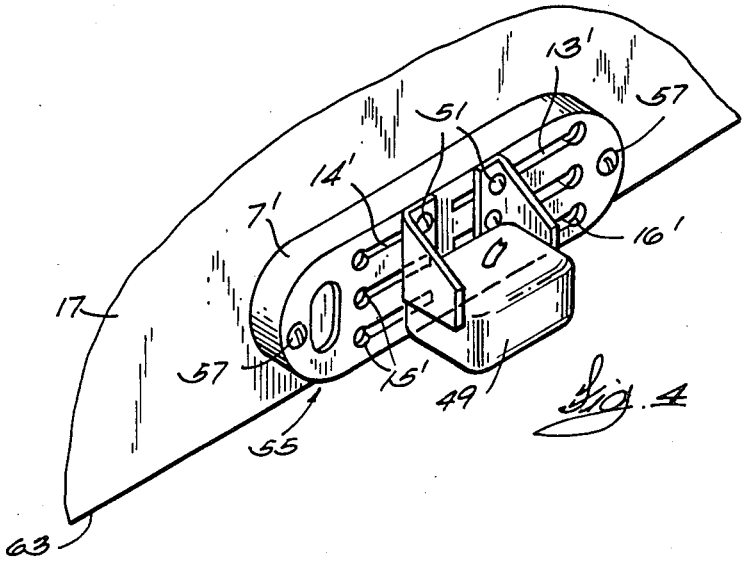
FIG. 4 is a perspective view of the transducer mounter of the present invention permanently installed on a boat.
Figure 6:
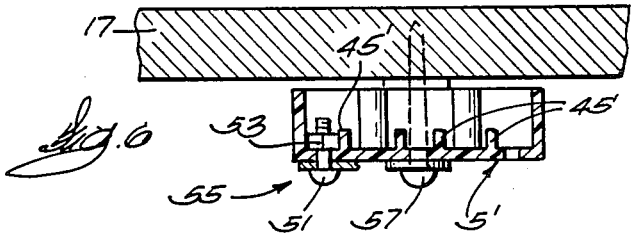
FIG. 6 is a cross-sectional view taken along lines 6—6 of FIG. 5.
Figure 5:
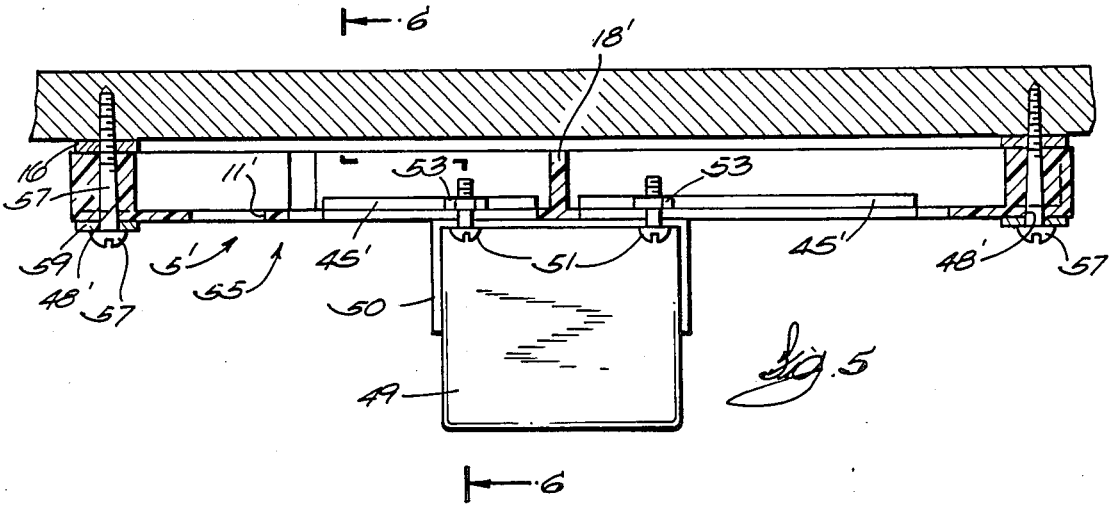
FIG. 5 is a horizontal cross-sectional view of the transducer mounter of FIG. 4.

Further in accordance with the present invention, a slightly modified transducer mounter is provided that may be permanently mounted to a boat. Turning to FIGS. 4–6, the transducer mounter 55 comprises a housing 5' that is substantially identical to the housing 5 described in conjunction with FIGURES 1–3. To permanently mount the housing 5' to the boat transom 17, lag screws 57 are employed that pass through clearance holes 48' in the housing. Metal washers 59 are placed under the heads of the screws 57, and additional washers 61 are interposed between the housing and the transom. When mounting the transducer mounter 55 to the boat, it is preferred that a housing side wall 7' be placed flush against the bottom corner 63 of the boat.

After the transducer mounter 55 has been installed, the transducer 49 and the mounting bracket 50 are fastened to the housing 5'. The nuts 53 are loosely started on the screws 51. The nuts are then pushed through the slot end holes 15' and 16' that best suit the desired final location of the transducer. The transducer is slid along the slots 13' and 14' to the desired location on the housing. By pulling the transducer away from the housing, friction between the nuts and the housing ribs 45' hold the nuts in place while the screws are tightened. Realignment of the transducer is easily accomplished by loosening the screws 51 slightly, adjusting the transducer on the housing to the desired location, and retightening the screws.

Thus, it is apparent that there has been provided, in accordance with the invention, a transducer mounter that fully satisfies the objects, aims, and advantages set forth above. While the invention has been described in conjunction with specific embodiments thereof, it is evident that many alternatives, modifications, and variations will be apparent to those skilled in the art in light of the foregoing dsecription. Accordingly, it is intended to embrace all such alternatives, modifications, and variations as fall within the spirit and broad scope of the appended claims.

I claim:

1. A transducer mounter comprising:

a. an elongated five-sided housing having opposed end walls, and opposed side walls and a front wall for defining a generally U-shaped cross section, the housing having first and second ends, the front wall defining a hole near the housing first end and at least one longitudinally extending slot that terminates near the housing second end, the slot being located and adapted to permit fastening a selected transducer to the housing front wall by means of the slot;

b. first mounting means for passing through the housing hole and for releasably securing the housing first end to a selected surface; and c. second mounting means for passing through a housing slot and for releasably securing the housing second end to the selected surface, so that the housing may be adjustably and releasably mounted to the selected surface.

2. The transducer mounter of claim 1 wherein:

a. the housing front wall hole is in the form of an obround hole having the major axis thereof transverse to the housing longitudinal axis, the obround hole major axis being larger than the first mounting means passing therethrough to thereby enable the housing to be angularly adjusted about the second mounting means on the selected surface; and b. the housing front wall defines a plurality of parallel slots extending generally between the housing second end and the housing obround hole.

3. A transducer mounter comprising:

a. an elongated housing having first and second ends and a front wall and a pair of opposed side walls connected to the front wall to give a generally U-shaped cross-section to the housing, the front wall defining a hole near the housing first end in the form of an obround hole having the major axis thereof transverse to the housing longitudinal axis, the housing front wall defining a plurality of parallel slots extending generally between the housing second end and the housing obround hole, wherein:

i. the housing front wall defines first and second sets of at least two longitudinally extending slots, the slots in the first set being generally colinear with the respective slots in the second set, the slots being located and adapted to permit fastening a selected transducer to the housing by means of the slots;

ii. a transverse rib is connected to the housing front wall and two side walls and separates the respective slots in the first and second sets; and iii. a plurality of longitudinally extending ribs are attached to the front wall and lie alongside the respective slots;

b. first mounting means for passing through the housing hole and for releasably securing the housing first end to a selected surface; and c. second mounting means for passing through a housing slot and for releasably securing the housing second end to the selected surface, so that the housing may be adjustably and releasably mounted to the selected surface.

4. A transducer mounter comprising:

a. an elongated housing having first and second ends and a front wall, the front wall defining a hole near the housing first end and at least one longitudinally extending slot that terminates near the housing second end, the slot being located and adapted to permit fastening a selected transducer to the housing by means of the slot;

b. first mounting means for passing through the housing hole and for releasably securing the housing first end to a selected surface; and c. second mounting means for passing through a housing slot and for releasably securing the housing second end to the selected surface, wherein the second mounting means comprises:

i. a suction cup adapted to be pressed against the selected surface and having an elongated threaded stem adapted to pass through a slot in the housing front wall; and ii. a nut threadable onto the suction cup stem with the stem extending through a housing slot for enabling releasable securement of the housing second end to the selected surface, so that the housing may be adjustably and releasably mounted to the selected surface.

5. In combination with a boat having a transom and a drain hole in the transom, a transducer mounter for releasably mounting a sonar transducer to the boat comprising:

a. an elongated housing having opposed end walls, opposed side walls, and a front wall spaced from the transom, the housing defining first and second ends, the front wall defining a hole located near the housing first end and at least one longitudinally extending slot that terminates near the housing second end, the slot being located and adapted to permit fastening the transducer to the housing front wall by means of the slot;

b. first mounting means for passing through the housing transom drain hole and housing hole and for releasably securing the housing first end to the boat transom; and c. second mounting means for passing through a housing slot and releasably securing the housing second end to the boat transom.

6. The combination of claim 5 wherein:

a. the housing front wall hole is in the form of an obround hole having the major axis thereof transverse to the housing longitudinal axis, the obround hole major axis being larger than the first mounting means passing therethrough to thereby enable the housing to be angularly adjusted about the second mounting means on the selected surface; and b. the housing front wall defines a plurality of parallel slots extending generally between the housing second end and the housing obround hole.

7. The combination of claim 5 wherein the first mounting means comprises:

a. a member having an elongated threaded shank and a head, the shank extending through the boat train hole and through the housing hole with the member head located inside the boat;

b. a nut threaded onto the member shank and bearing against the outside of the transom between the transom and the housing front wall to releasably secure the member to the boat; and c. a knob threaded onto the member shank to bear against the housing front wall to releasably secure the housing to the outside of the boat.

8. In combination with a boat having a transom and drain hole in the transom, a transducer mounter for releasably mounting a sonar transducer to the boat comprising:

a. an elongated housing having first and second ends and a front wall and a pair of opposed side walls connected to the front wall to give a generally U-shaped cross-section to the housing, the front wall defining a hole located near the housing first end in the form of a obround hole having the major axis thereof transverse to the housing longitudinal axis, the housing front wall defining a plurality of parallel slots extending generally between the housing second end and the housing obround hole, wherein:

i. the housing front wall defines first and second sets of at least two longitudinally extending slots, the slots in the first set being generally colinear with the respective slots in the second set, the slots being located and adapted to permit fastening the transducer to the housing by means of the slot;

ii. a transverse rib is connected to the housing front wall and two side walls and separates the respective slots in the first and second sets thereof; and iii. a plurality of longitudinally extending ribs are attached to the front wall and lie alongside the respective slots;

b. first mounting means for passing through the housing hole and for releasably securing the housing first end to the boat transom; and c. second mounting means for passing through a housing slot and for releasably securing the housing second end to the boat transom.

9. In combination with a boat having a transom and a drain hole in the transom, a transducer mounter for releasably mounting a sonar transducer to the boat comprising:

a. an elongated housing first and second ends and a front wall, the front wall defining a hole located near the housing first end and at least one longitudinally extending slot that terminates near the housing second end, the slot being located and adapted to permit fastening the transducer to the housing by means of the slot;

b. first mounting means for passing through the housing hole and for releasably securing the housing first end to the boat transom; and c. second mounting means for passing through a housing slot and for releasably securing the housing second end to the boat transom, wherein the second mounting means comprises:

i. a suction cup adapted to be pressed against the boat transom and having an elongate threaded stem passing through a slot in the housing front wall; and ii. a nut threaded onto the suction cup stem to releasably secure the housing second end to the boat transom.

10. In combination with a boat having a transom and drain hole in the transom, a transducer mounter for releasably mounting a sonar transducer to the boat comprising:

a. an elongated housing having first and second ends and a front wall, the front wall defining a hole located near the housing first end and at least one longitudinally extending slot that terminates near the housing second end, the slot being located and adapted to permit fastening the transducer to the housing by means of the slot;

b. first mounting means comprising:

i. a member having an elongated threaded shank and an enlarged head, the shank extending through the boat drain hole and through the housing enlarged hole, the member head being located on the inside of the boat;

ii. a nut threaded onto the member shank and bearing against the boat transom to releasably secure the member to the boat; and iii. a knob threaded onto the member shank and bearing against the housing wall to secure the housing to the outside of the boat transom; and c. second mounting means comprising:

i. a suction cup pressed against the boat transom and having an elongated threaded stem passing through a slot in the housing front wall; and ii. a nut threaded onto the suction cup stem and bearing against the housing front wall to releasably secure the housing second end to the boat transom, so that the housing and transducer fastened thereto may be removed from the boat by loosening the knob turned onto the adapter and the nut turned onto the suction cup stem to thereby render the housing and the transducer portable as a unit.

11. In combination with a boat having a transom, a transducer mounter for adjustably mounting a sonar transducer to the boat comprising:

a. an elongated housing having a front wall that defines a plurality of generally parallel longitudinally extending slots, each slot terminating in at least one end thereof in an opening larger than the slot width, the housing having a pair of side walls joined to the front wall to give the housing a generally U-shaped transverse cross section, wherein:

i. the housing front wall is formed with longitudinally extending ribs that lie alongside the respective slots; and ii. the transducer is mounted to the housing by nuts that are insertable through the front wall enlarged openings and that straddle the slot ribs; and b. fastening means for fastening the housing to the boat transom, so that the transducer may be adjustably fastened to the housing by means of the slots.

12. A method of releasably mounting a sonar transducer to a boat transom having a drain hole therethrough comprising the steps of:

a. providing an elongated housing having a hole and a plurality of longitudinally extending slots;

b. inserting a first threaded member through the boat transom drain hole;

c. turning a nut onto the first member to retain the member in the drain hole;

d. providing a suction cup having a threaded stem, and pressing the suction cup against the boat transom;

e. fastening a sonar transducer to the housing;

f. placing the housing hole over the first member and a housing slot over the suction cup threaded stem; and g. turning nuts onto the first and second members and against the housing to secure the housing to the boat transom.

* * * * *